US006575708B2

(12) United States Patent
DeWispelaere

(10) Patent No.: US 6,575,708 B2
(45) Date of Patent: Jun. 10, 2003

(54) COMPRESSOR HEAD WITH IMPROVED OIL RETENTION

(75) Inventor: Bradley J. DeWispelaere, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/951,248

(22) Filed: Sep. 13, 2001

(65) Prior Publication Data

US 2003/0049140 A1 Mar. 13, 2003

(51) Int. Cl.[7] ..... F04B 27/08

(52) U.S. Cl. ..... 417/269; 417/222.2; 417/313; 417/281

(58) Field of Search ..... 417/222.2, 269, 417/281, 313, 440, 540; 184/6.8, 6.17

(56) References Cited

U.S. PATENT DOCUMENTS 4,815,943 A * 3/1989 Kawashima et al. ..... 417/222.2
5,088,897 A * 2/1992 Kawai et al. ..... 417/269
5,167,492 A * 12/1992 Kent et al. ..... 417/222.2
5,316,446 A * 5/1994 Kimura et al. ..... 417/269
5,401,150 A 3/1995 Brown
6,010,314 A 1/2000 Kobayashi
6,077,049 A 6/2000 Nakamura
6,149,398 A * 11/2000 Fukanuma et al. ..... 417/222.2
6,179,578 B1 1/2001 Kayukawa
6,203,284 B1 3/2001 Kawaguchi

* cited by examiner

*Primary Examiner*—Cheryl J. Tyler
(74) *Attorney, Agent, or Firm*—Patrick M. Griffin

(57) ABSTRACT

A head assembly for use in a compressor having a first compression chamber for compressing a fluid includes a manifold housing defining an intake port, an exhaust port and a control valve port and having an outer wall, a first inner wall and a second inner wall. The outer wall and the first inner wall define a suction chamber and the first inner wall and the second inner wall define a discharge chamber. An aperture is formed in the first inner wall for guiding the fluid and oil from the discharge chamber to the control valve port. The second inner wall is internal to the outer wall and the first inner wall and defines an exit chamber. The exit chamber is in fluid communication with the exhaust port and the second inner wall defines a partition between the aperture and the exhaust port such that the oil pools in the discharge chamber.

14 Claims, 4 Drawing Sheets

FIG-3
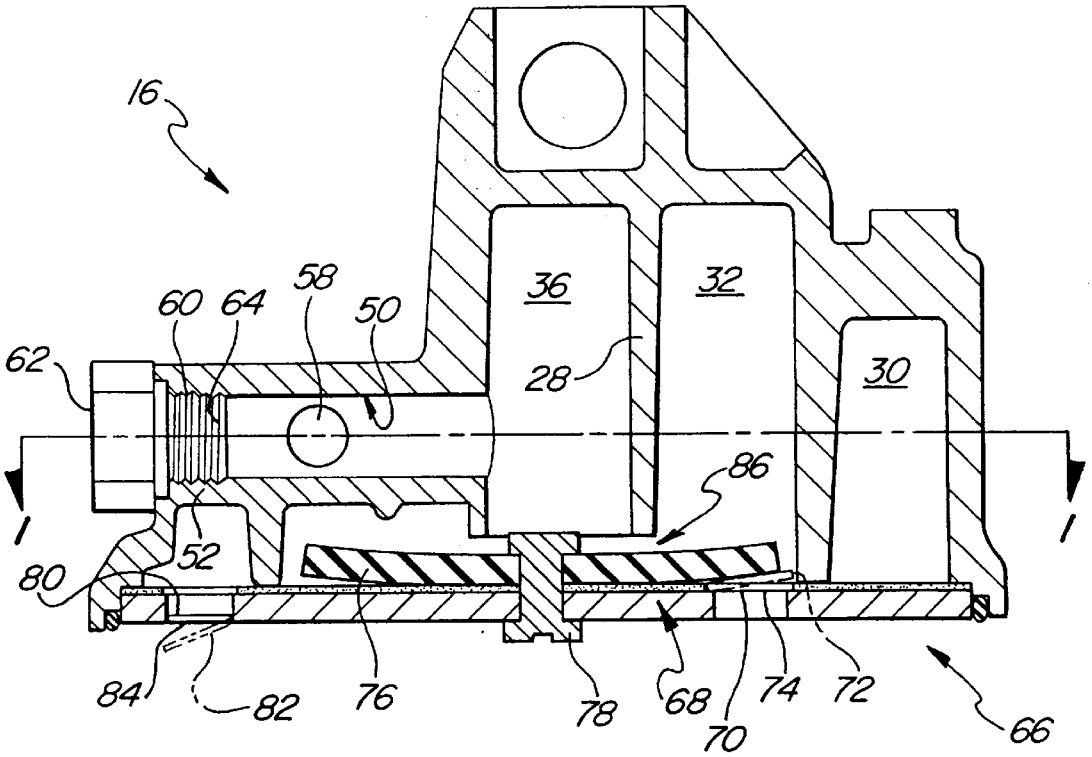
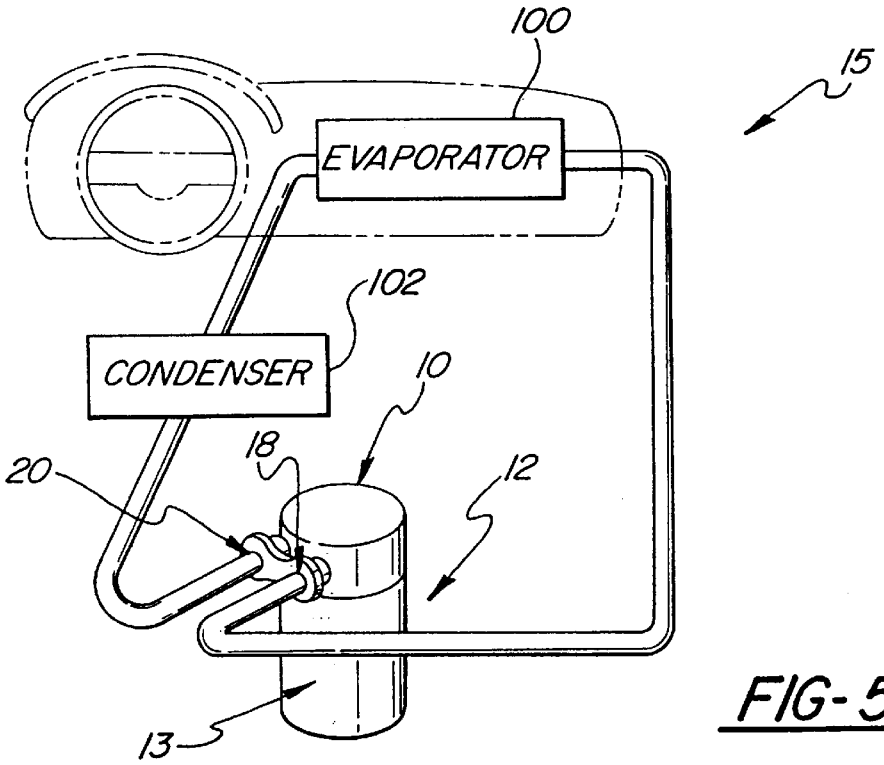
FIG-5

COMPRESSOR HEAD WITH IMPROVED OIL RETENTION

FIELD OF THE INVENTION

A head assembly for use in a compressor having a compression chamber for compressing a fluid is disclosed. More specifically, the head assembly includes an improvement for retaining oil in the compressor.

BACKGROUND OF THE INVENTION

Vehicle air-conditioning systems include a compressor that compresses and superheats refrigerant. The refrigerant exits the compressor and continues first to a condenser and then to an expander. From the expander, the refrigerant enters an evaporator and then returns to the compressor to begin the cycle again. Occasionally, the air-conditioning system will include either an accumulator/dehydrator (A/D) or a receiver/dehydrator (R/D). The purpose of these devices is to remove moisture from the refrigerant and to store a reserve charge of the system until it is needed upon demand.

Generally, the compressor is a belt-driven pump that includes at least one compression chamber and a head assembly comprising a manifold housing, an intake port and an exhaust port. The manifold housing further defines a suction chamber and a discharge chamber. The intake port guides the refrigerant from the evaporator to the suction chamber. The suction chamber subsequently guides the refrigerant from the intake port to the compression chamber where it is compressed. The compressed refrigerant is received in the discharge chamber and from the discharge chamber the refrigerant is exhausted to the exhaust port. The refrigerant is then guided from the exhaust port to the condenser to begin the cycle again.

Prior art head assemblies experience oil retention problems and difficulty protecting the compressor from wear. Oil retention is crucial for lubricating the working components of the compressor. Retaining oil in the compressor increases the life of the compressor.

Prior art head assemblies, such as those shown in U.S. Pat. No. 6,010,314 to Kobayashi et al. and U.S. Pat. No. 6,179,578 to Kayukawa et al. provide oil separation mechanisms in an attempt to increase oil retention within the compressor. The '578 patent to Kayukawa et al. utilizes a plug structure for separating the oil from the refrigerant as the refrigerant enters the exhaust port. The plug structure complicates manufacture of the head assembly and increases the cost thereof.

The '314 patent to Kobayashi et al. includes an oil retention housing defining a oil retention chamber wherein the housing is mounted to an outside wall of the compressor. The refrigerant and oil exit the discharge chamber to the oil retention chamber and gravity pulls the oil toward a bottom end of the oil retention chamber. A supply line connects the oil retention chamber to a lubrication chamber, which stores the oil in the compressor for lubricating the components. One disadvantage of the Kobayashi apparatus is that the oil retention chamber requires additional structure with the existing head assembly and compressor thereby increasing costs and hampering ease of manufacture. Furthermore, the oil retention chamber must be located above the compressor, posing packaging issues and the fixed orifice supply line results in performance losses within the air-conditioning system.

Both the '578 patent to Kayukawa et al. and the '314 patent to Kobayashi et al. include head assemblies wherein the discharge chamber substantially surrounds the suction chamber and is unobstructed in relation to the exhaust port. This configuration limits oil retention within the compressor by not providing a sufficient barrier between the discharge chamber and the exhaust port. Additionally, both the '578 patent to Kayukawa et al. and the '314 patent to Kobayashi et al. require additional structures that complicates manufacture of the head assembly. As a result, there is a need for a head assembly that increases oil retention in the compressor without adding additional, unnecessary structural components or separate structures, resulting in easier manufacturing and a more economical head assembly.

SUMMARY OF THE INVENTION AND ADVANTAGES

In one aspect of the present invention, a head assembly for use in a compressor having oil for lubrication and defining a first compression chamber for compressing a fluid is provided. The head assembly includes a manifold housing defining an intake port, an exhaust port and a control valve port. The manifold housing comprises an outer wall, a first inner wall and a second inner wall wherein the outer wall and the first inner wall define a suction chamber in fluid communication with the intake port for receiving the fluid from the intake port and guiding the fluid to the first compression chamber. The first inner wall and the second inner wall define a discharge chamber for receiving the fluid from the first compression chamber. An aperture is formed in the first inner wall for guiding the fluid and the oil from the discharge chamber to the control valve port. The second inner wall is internal to the outer wall and the first inner wall and defines an exit chamber for guiding the fluid from the discharge chamber to the exhaust port. The exit chamber is in fluid communication with the exhaust port and the second inner wall defines a partition between the aperture and the exhaust port such that the oil pools in the discharge chamber between the first inner wall and the second inner wall thereby retaining the oil in the compressor to lubricate the compressor.

In another aspect of the present invention, a compressor assembly for compressing a fluid and having oil for lubrication is provided. The compressor includes a compressor housing defining a compression chamber for compressing the fluid. A piston is disposed in the compression chamber and is slidably movable within the compression chamber. A manifold housing is coupled to the compressor housing and defines an intake port, an exhaust port and a control valve port. The manifold housing comprises an outer wall, a first inner wall and a second inner wall. The outer wall and the first inner wall define a suction chamber in fluid communication with the intake port for receiving the fluid from the intake port and guiding the fluid to the compression chamber. The first inner wall and the second inner wall define a discharge chamber for receiving the fluid from the compression chamber. An aperture is formed in the first inner wall for guiding the fluid and the oil from the discharge chamber to the control valve port. The second inner wall is internal to the outer wall and the first inner wall and defines an exit chamber for guiding the fluid from the discharge chamber to the exhaust port. Additionally, the exit chamber is in fluid communication with the exhaust port and the second inner wall defines a partition between the aperture and the exhaust port such that the oil pools in the discharge chamber between the first inner wall and the second inner wall thereby retaining the oil in the compressor to lubricate the compressor.

Accordingly, the advantage of the subject invention described above is the ability of the subject invention to effectively increase oil retention within the compressor without adding unnecessary structure or plugs to the head assembly. More specifically, the advantage of the subject invention is the configuration of the second inner wall wherein the second inner wall provides the barrier between the aperture and the exhaust port. This barrier is critical in pooling the oil in the manifold housing prior to being discharged to the control valve port. Furthermore, the subject invention is easy to manufacture relative to the prior art head assemblies and the subject invention provides additional advantages that will become apparent from the description of the preferred embodiment including higher efficiency and increased performance.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a cross-sectional perspective view of the head assembly of FIG. 1 as taken along line 3—3 of FIG. 2;

FIG. 5 is a system view of an air-conditioning system including a perspective view of the compressor of FIG. 4 including the head assembly and also schematically representing an evaporator and a condenser.

DETAILED DESCRIPTION OF THE PREFERRED EMBODIMENT

Referring to the Figures, wherein like numerals indicate like or corresponding parts throughout the several views, a head assembly 10 for use in a compressor (or compressor assembly) 12 having a compressor housing 13 and defining a first compression chamber 14 for compressing a fluid is disclosed. It is to be understood that the subject invention is intended to be used in conjunction with an air-conditioning system 15 that utilizes refrigerant for cooling, however, this is not intended to limit the subject invention. Other systems or fluids such as, but not limited to air could also be used in conjunction with the subject invention.

Figure 1:
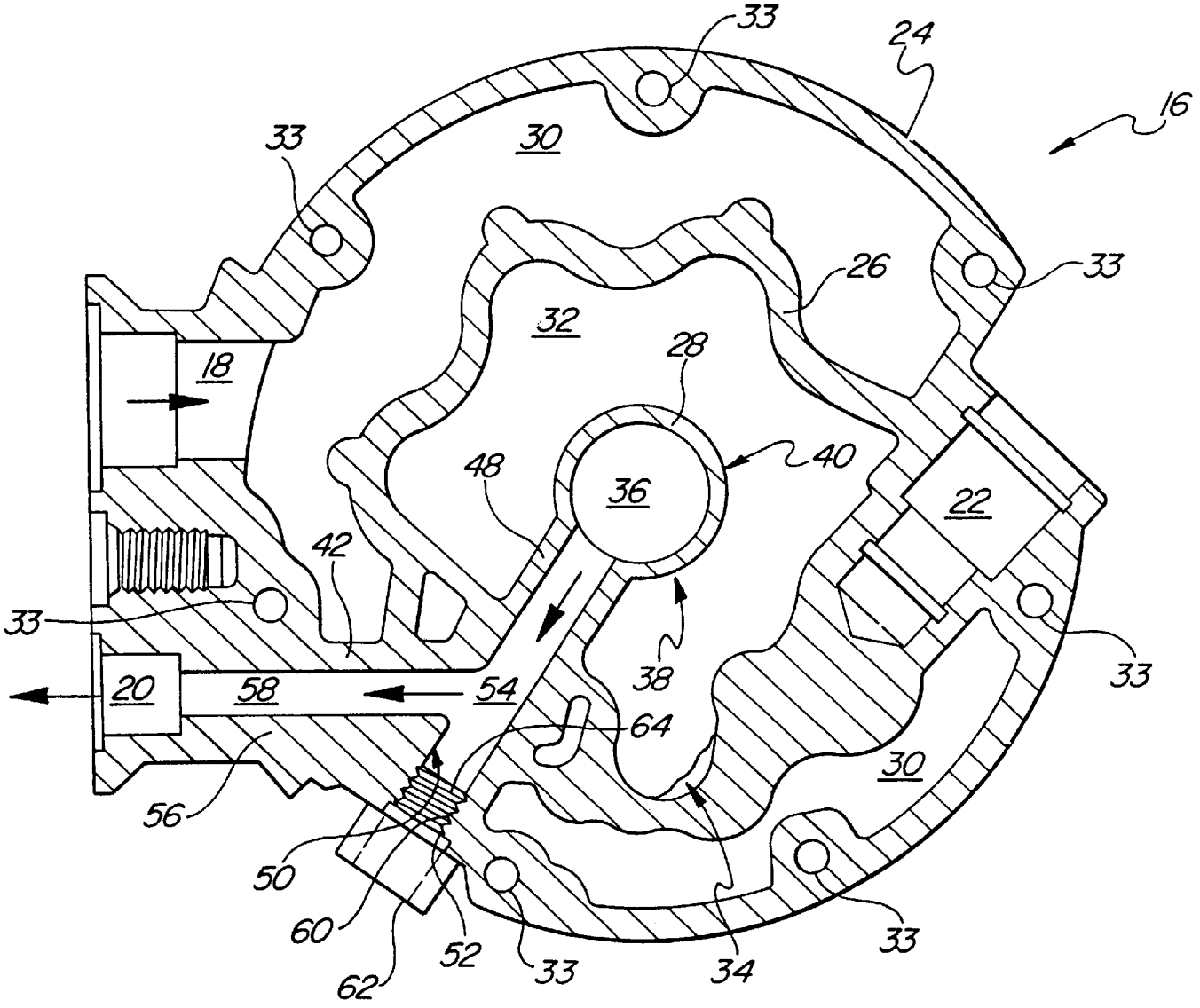
FIG. 1 is a cross-sectional view of a head assembly of FIG. 3 as taken along line 1—1 of FIG. 3.
Figure 2:
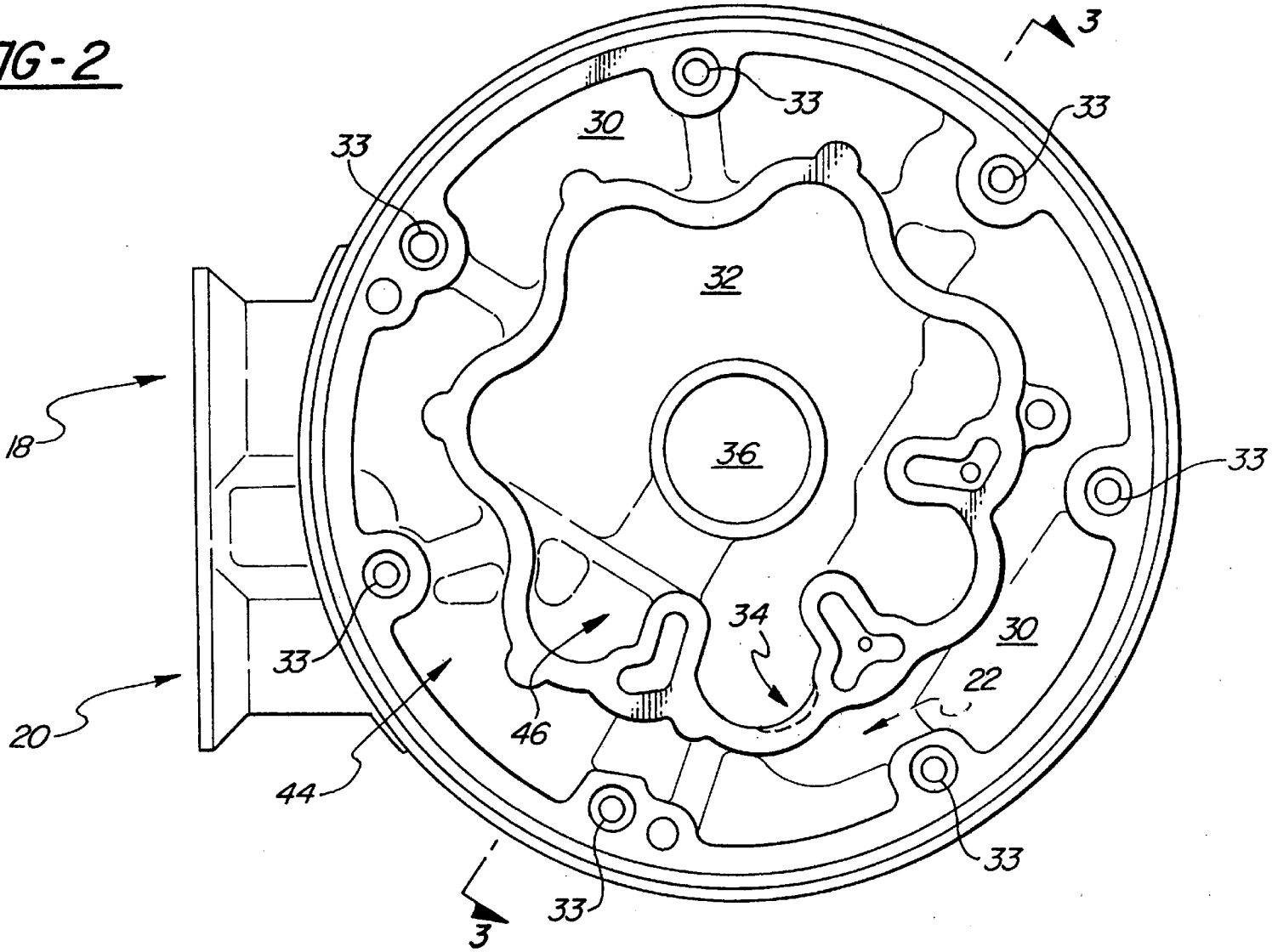
FIG. 2 is a plan view of the head assembly of FIG. 1.

Referring to FIGS. 1 and 2, the head assembly 10 comprises a manifold housing 16 defining an intake port 18, an exhaust port 20 and a control valve port 22. The manifold housing 16 includes an outer wall 24, a first inner wall 26 and a second inner wall 28. The outer wall 24 and the first inner wall 26 define a suction chamber 30 that is in fluid communication with the intake port 18 for receiving the fluid from the intake port 18 and guiding the fluid to the first compression chamber 14. The first inner wall 26 and the second inner wall 28 define a discharge chamber 32 for receiving the fluid from the first compression chamber 14.

In the preferred embodiment, the outer wall 24, the first inner wall 26 and the second inner wall 28 are integrally formed with the manifold housing 16 and the manifold housing 16 is made from die cast aluminum. It is to be understood that the manifold housing 16 is not limited to integrally formed walls or die cast aluminum. The manifold housing 16 may be made from a number of materials including, but not limited to, steel, iron, and so on. Furthermore, the manifold housing 16 is mounted to the compressor 12 by a plurality of through bolts (not shown) positioned within a matching plurality of mounting bores 33 that are circumferentially spaced within the outer wall 24. Any number of attaching devices could be used to mount the manifold housing 16 to the compressor 12 and this is not intended to limit the subject invention.

An aperture 34 is formed in the first inner wall 26 for guiding the fluid and oil from the discharge chamber 32 to the control valve port 22. The second inner wall 28 is internal to the outer wall 24 and the first inner wall 26. The second inner wall 28 defines an exit chamber 36 for guiding the fluid from the discharge chamber 32 to the exhaust port 20. The exit chamber 36 is in fluid communication with the exhaust port 20. The second inner wall 28 defines a partition 38 between the aperture 34 and the exhaust port 20 such that the oil pools in the discharge chamber 32 between the first inner wall 26 and the second inner wall 28 thereby retaining the oil in the compressor 12 to lubricate the compressor 12. The oil is entrained in the fluid for lubricating the compressor, which increase the life expectancy of working components within the compressor 12. The second inner wall 28 has a continuous outer surface 40, which forces the oil to pool between the first inner wall 26 and the outer surface 40. The discharge chamber 32 substantially surrounds the exit chamber 36 in this embodiment. As a result, the oil can pool within the discharge chamber 32 around the outer surface 40 of the second inner wall 28 until the oil spills over the second inner wall 28 into the exit chamber 36. A further advantage of the position of the exit chamber 36 with respect to the discharge chamber 32 is the effect on pressure pulsations within the compressor 12. Testing of the compressor 12 with the head assembly 10 has shown that off-order pressure pulsations have been substantially suppressed by utilizing a centrally located exit chamber 36. Gas pulsations circulating through the compressor are forced from the discharge chamber 32 to the exit chamber 36. As a result, off-order pressure pulsations are suppressed, leaving behind primary pumping order pressure pulsations ($7^{th}$ order, $14^{th}$ order and $21^{st}$ order).

In the preferred embodiment, the head assembly 10 further includes an exhaust housing 42 integrally formed with the manifold housing 16. The exhaust housing 42 further defines the exhaust port 20. The exhaust housing 42 also defines a suction barrier 44 between the exhaust port 20 and the suction chamber 30 to prevent fluid in the exhaust port 20 from being transferred to the suction chamber 30. In addition, the exhaust housing 42 defines a discharge barrier 46 between the exhaust port 20 and the discharge chamber 32 to prevent oil in the discharge chamber 32 from escaping from the compressor 12 through the exhaust port 20.

The exhaust housing 42 further includes a first channel wall 48 having an internal surface 50 and a first end 52 defining a first channel 54 and a second channel wall 56 defining a second channel 58. The first channel 54 is in fluid communication with the exit chamber 36 and the second channel 58 is in fluid communication with the first channel 54 such that the fluid travels from the exit chamber 36 to the first channel 54 then to the second channel 58 and finally is exhausted from the second channel 58. It is to be understood that any number of channels may be used to exhaust the fluid from the exit chamber 36 back to the air-conditioning system 15. In the preferred embodiment, the internal surface 50 of the first channel wall 48 includes female threads 60 near the first end 52. The female threads 60 are intended to engage a high pressure relief valve 62 having male threads 64. The high pressure relief valve 62 provides pressure relief in the compressor 12. The high pressure relief valve 62 releases fluid from the air-conditioning system 15 when pressure within the system 15 reaches a predetermined value.

Referring to FIG. 3, the subject invention further includes a valve plate 66 positioned between the manifold housing 16 and the first compression chamber 14. The valve plate 66 and the second inner wall 28 define a trap 68 for separating debris from the fluid and preventing the debris from entering said exhaust port 20. Trapping the debris that is either ingested or produced by the compressor 12 is important for preventing the restriction of flow of the fluid through the remaining components of the air-conditioning system 15. Specifically, the debris that exits the compressor 12 that is larger than 0.5 mm can result in a debilitated air-conditioning system 15.

Further included is a discharge reed 70. The discharge reed 70 engages the valve plate 66 and is positioned between the valve plate 66 and the manifold housing 16. The discharge reed 70 is movable between a discharge position 72 (as shown in dashed lines) and a closed position 74 such that the fluid enters the discharge chamber 32 from the first compression chamber 14 when the discharge reed 70 is in the discharge position 72. The discharge reed 70 prevents the fluid from re-entering the first compression chamber 14 from the discharge chamber 32 when in the closed position 74. The discharge reed 70 is held in place by a discharge reed retainer 76 that is secured to the valve plate 66. The discharge reed 70 is positioned between the discharge reed retainer 76 and the valve plate 66. A fastener 78 is used to attach the discharge reed retainer 76 to the valve plate 66. In the preferred embodiment, the fastener 78 is a rivet, however, it is to be understood that any fastening device may be used, such as, but not limited to, a screw, a bolt and nut assembly, a weld, a clip and so on.

The head assembly 10 further includes a suction reed 80. The suction reed 80 engages the valve plate 66 for regulating the movement of the fluid from the suction chamber 30 to the first compression chamber 14. The suction reed 80 is movable between a suction position 82 and a shutoff position 84 such that the fluid enters the first compression chamber 14 when the suction reed 80 is in the suction position 82 (as shown in dashed lines) and the suction reed 80 prevents the fluid from re-entering the suction chamber 30 from the first compression chamber 14 when in the shutoff position 84. Both the discharge reed 70 and the suction reed 80 are made from steel, more specifically, a 1% carbon flapper valve steel to add flexibility to the reeds 70,80. The reed material is not limited to steel and could include a variety of materials including a composite material, aluminum and so on.

The discharge reed retainer 76 and the second inner wall 28 define a debris trap 86 for separating the debris from the fluid and preventing the debris from entering the exhaust port 20. The debris trap 86 is to be distinguished from the trap 68 in that the debris trap 86 is defined by the discharge reed retainer 76 and the second inner wall 28 and the trap 68 is defined by the valve plate 66 and the second inner wall 28. In the preferred embodiment, the debris trap 86 is sized to prevent the debris greater than 0.5 mm in size from entering the exit chamber 36.

Figure 4:
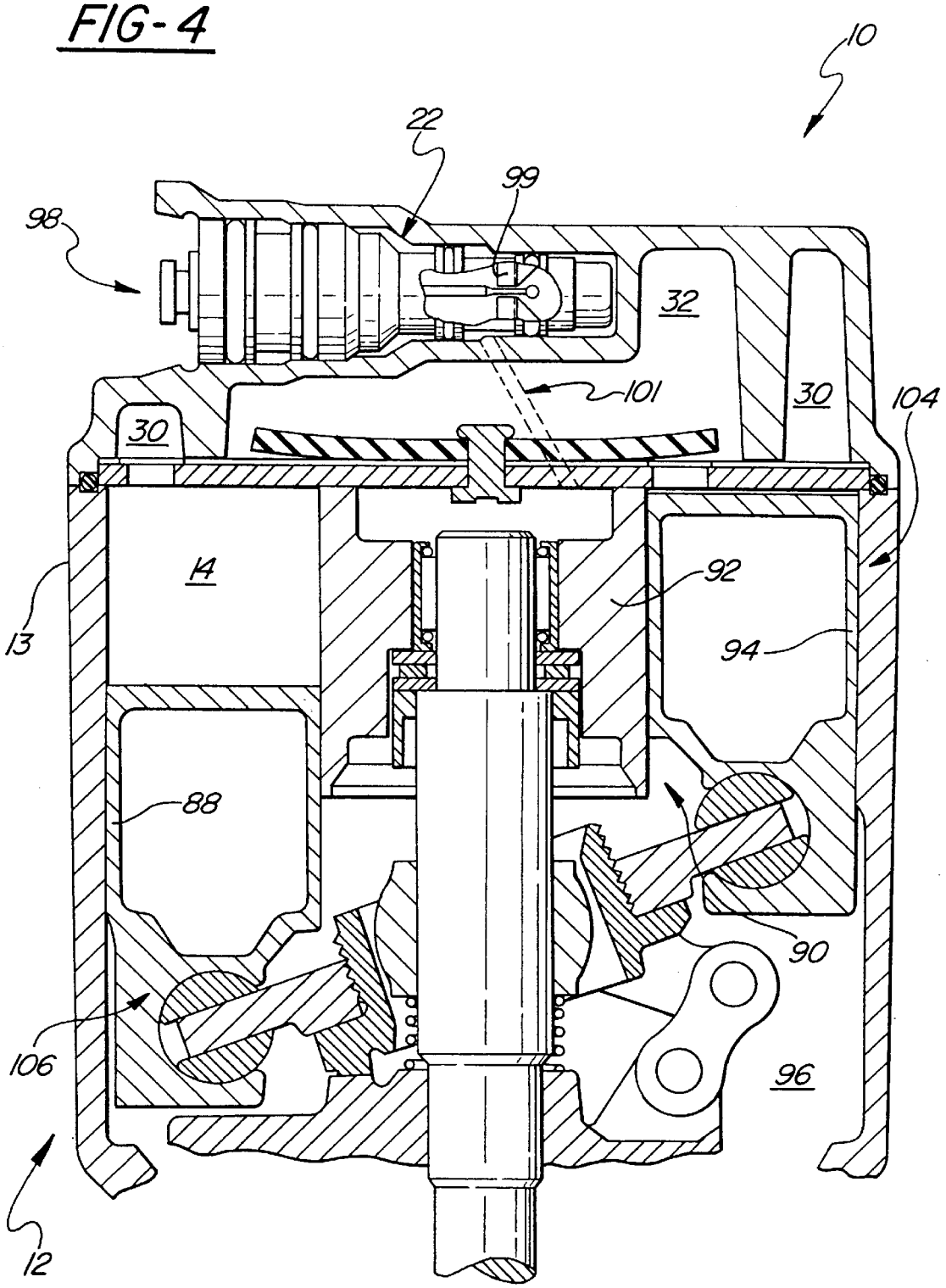
FIG. 4 is an illustrative view of the head assembly generally illustrating fluid communication between a control valve port and a lubrication chamber.

The compressor 12, as shown in FIG. 4, includes a piston 88 slidably moveable within the first compression chamber 14 for compressing the fluid in the compressor 12. The compressor 12 further defines a second compression chamber 90 spaced apart from the first compression chamber 14 for receiving the fluid from the suction chamber 30 in the same manner as the first compression chamber 14. A cylinder wall 92 separates the first compression chamber 14 and the second compression chamber 90 and a second piston 94 is positioned in the second compression chamber 90 and is slidably moveable therein for compressing the fluid in the compressor 12. In the preferred embodiment, the compressor 12 includes seven pistons and seven compression chambers, however, for simplicity, only the first and the second pistons 88,94 and compression chambers 14,90 are discussed. The number of pistons and compression chambers is not intended to limit the subject invention.

The compressor 12 also defines a lubrication chamber 96 for storing the oil in the compressor 12. The lubrication chamber 96, sometimes referred to as a crankcase, is used to supply the oil to the pistons 88,94 to minimize friction along the cylinder wall 92. The oil that is stored in the lubrication chamber 96 is also used to lubricate other moving parts in the compressor. It is a feature of the subject invention to increase the retention of the oil in the compressor 12 and more specifically, to retain the oil in the lubrication chamber 96.

Referring to FIG. 4, a control valve plug 98 is generally shown. The control valve plug 98 is disposed within the control valve port 22 for regulating the flow of the fluid and the oil from the discharge chamber 32 to the lubrication chamber 96, thereby, regulating pressure within the compressor 12. The control valve plug 98 includes a control valve 99 that is in fluid communication with the discharge chamber 32 through the aperture 34 formed in the first inner wall 26 and as a result, the control valve 99 controls the movement of fluid through the aperture 34.

The control valve 99 is opened and closed based on the operation of the air-conditioning system 15. The control valve plug 98 shown in FIG. 4 is of the pneumatic type. The opening and closing of the control valve 99 is regulated by incoming suction pressure. A control valve set point is established at the factory. The control valve 99 opens and closes relative to the set point. When the incoming suction pressure is higher than the set point, the control valve 99 is closed and the compressor 12 is at full stroke or full displacement. The control valve plug 98 could also be of the electronic type. In such a case, an electrical signal is used to actuate the control valve 99.

When the control valve 99 is closed, the only pathway for the fluid that enters the discharge chamber is into the exit chamber 36 and then through the first and second channels 54,58 to the air-conditioning system 15. During this fluid movement, the oil that is entrained in the fluid is pooled in the discharge chamber 32 near the aperture 34. When the control valve 99 is opened, the fluid in the discharge chamber 32 and the oil that has pooled near the aperture 34 is drawn into a fluid line 101 that connects the control valve port 22 to the lubrication chamber 96. It is to be understood that the fluid line 101 could be an additional line, but in the subject invention, the fluid line 101 is an existing line connected to the control valve 99 for regulating pressure in the compressor 12.

Referring to FIG. 5, the air-conditioning system 15 of the preferred embodiment includes an evaporator 100 for transferring heat and a condenser 102 in fluid communication with the evaporator 100. It is understood that a conventional air-conditioning system may include additional components, however, only the general configuration as shown in FIG. 5 will be discussed. Furthermore it is to be understood that the lines connecting the evaporator 100, condenser 102 and compressor 12 are for schematic representation only and are not intended to represent structure. The condenser 102 receives the fluid from the compressor 12. From the condenser 102, the fluid travels to the evaporator 100. The compressor 12 works in concert with the evaporator 100 and the condenser 102 as part of the air-conditioning system 15 such that the fluid enters the intake port 18 from the air-conditioning system 15 and exits the exhaust port 20 to be recirculated in the air-conditioning system 15.

When the compressor 12 is in operation in the preferred embodiment, the pistons 88,94 are reciprocated or slidably moved within their respective compression chambers 14,90. The suction reed 80 is moved to the suction position 82 as the piston 88 moves from a top dead center position 104 toward the lubrication chamber 96 thereby drawing the fluid into the respective compression chamber 14,90. Furthermore, as the second piston 94 moves from a bottom dead center position 106 toward the valve plate 66, the discharge reed 70 is moved to the discharge position 72 thereby forcing the fluid into the discharge chamber 32. In the preferred embodiment, all seven compression chambers include both suction reeds 80 and discharge reeds 70 to control the movement of the fluid within the compressor 12.

Obviously, many modifications and variations of the present invention are possible in light of the above teachings. The invention may be practiced otherwise than as specifically described within the scope of the appended claims.

What is claimed is:

1. A head assembly for use in a compressor defining a compression chamber, comprising:

a manifold housing defining an intake port, an exhaust port and a control valve port and having an outer wall, a first inner wall and a second inner wall;

a suction chamber defined between said outer wall and said first inner wall in fluid communication with said intake port for receiving the fluid from said intake port and guiding the fluid to the compression chamber;

a discharge chamber defined between said first inner wall and said second inner wall for receiving the fluid from the compression chamber;

an aperture formed in said first inner wall for guiding the fluid and oil from said discharge chamber to said control valve port wherein said second inner wall defines a partition between said aperture and said exhaust port such that the oil pools in said discharge chamber between said first inner wall and said second inner wall thereby retaining the oil in the compressor to lubricate the compressor; and an exit chamber defined within said second inner wall in fluid communication with said exhaust port and said discharge chamber such that the fluid in said discharge chamber must pass through said exit chamber to reach said exhaust port.

2. The assembly as set forth in claim 1 wherein said second inner wall further includes an outer surface, said outer surface being continuous for allowing the oil to pool between said first inner wall and said outer surface.

3. The assembly as set forth in claim 2 further including an exhaust housing integrally formed with said manifold housing, said exhaust housing further defining said exhaust port.

4. The assembly as set forth in claim 3 wherein said exhaust housing defines a suction barrier between said exhaust port and said suction chamber to prevent fluid in said suction chamber from being transferred to said exhaust port.

5. The assembly as set forth in claim 3 wherein said exhaust housing defines a discharge barrier between said exhaust port and said discharge chamber to prevent oil in said discharge chamber from escaping from the compressor through said exhaust port.

6. A head assembly for use in a compressor using oil for lubrication and defining a compression chamber for compressing a fluid, said assembly comprising:

a manifold housing defining an intake port, an exhaust port, and a control valve port and having an outer wall, a first inner wall and a second inner wall internal to said outer wall and said first inner wall;

a suction chamber defined by said outer wall and said first inner wall in fluid communication with said intake port for receiving the fluid from said intake port and for guiding the fluid to the compression chamber;

a discharge chamber defined by said first inner wall and said second inner wall for receiving the fluid from the compression chamber;

an aperture formed in said first inner wall for guiding the fluid and the oil from said discharge chamber to said control valve port wherein said second inner wall includes a continuous outer surface defining a partition between said aperture and said exhaust port such that the oil pools in said discharge chamber between said first inner wall and said second inner wall thereby retaining the oil in the compressor to lubricate the compressor;

an exit chamber defined by said second inner wall in fluid communication with said exhaust port for guiding the fluid from said discharge chamber to said exhaust port; and an exhaust housing integrally formed with said manifold housing further defining said exhaust port and including a first channel wall having an internal surface and a first end defining a first channel in fluid communication with said exit chamber and a second channel wall defining a second channel in fluid communication with said first channel.

7. The assembly as set forth in claim 6 wherein said internal surface of said first channel wall further includes female threads near said first end.

8. The assembly as set forth in claim 7 further including a high pressure relief valve having male threads, said male threads engaging said female threads of said first channel for providing pressure relief in the compressor.

9. A head assembly for use in a compressor using oil for lubrication and defining a compression chamber for compressing a fluid, said assembly comprising:

a manifold housing defining an intake port, an exhaust port and a control valve port and having an outer wall, a first inner wall and a second inner wall internal to said outer wall and said first inner wall;

a suction chamber defined by said outer wall and said first inner wall in fluid communication with said intake port for receiving the fluid from said intake port and for guiding the fluid to the compression chamber;

a discharge chamber defined by said first inner wall and said second inner wall for receiving the fluid from the compression chamber;

an aperture formed in said first inner wall for guiding the fluid and the oil from said discharge chamber to said control valve port wherein said second inner wall defines a partition between said aperture and said exhaust port such that the oil pools in said discharge chamber between said first inner wall and said second inner wall thereby retaining the oil in the compressor to lubricate the compressor;

an exit chamber defined by said second inner wall in fluid communication with said exhaust port for guiding the fluid from said discharge chamber to said exhaust port; and a valve plate adjacent said manifold housing for positioning between said manifold housing and the compression chamber wherein said valve plate and said second inner wall define a trap for separating debris from the fluid and preventing the debris from entering said exhaust port.

10. A head assembly for use in a compressor using oil for lubrication and defining a compression chamber for compressing a fluid, said assembly comprising:

a manifold housing defining an intake port, an exhaust port and a control valve port and having an outer wall, a first inner wall and a second inner wall internal to said outer wall and said first inner wall;

a suction chamber defined by said outer wall and said first inner wall in fluid communication with said intake port for receiving the fluid from said intake port and for guiding the fluid to the compression chamber;

a discharge chamber defined by said first inner wall and said second inner wall for receiving the fluid from the compression chamber;

an aperture formed in said first inner wall for guiding the fluid and the oil from said discharge chamber to said control valve port wherein said second inner wall defines a partition between said aperture and said exhaust port such that the oil pools in said discharge chamber between said first inner wall and said second inner wall thereby retaining the oil in the compressor to lubricate the compressor;

an exit chamber defined by said second inner wall in fluid communication with said exhaust port for guiding the fluid from said discharge chamber to said exhaust port;

a valve plate adjacent said manifold housing for positioning between said manifold housing and the compression chamber;

a discharge reed engaging said valve plate and positioned between said valve plate and said manifold housing for regulating the movement of the fluid between the compression chamber and said discharge chamber; and a discharge reed retainer secured to said valve plate for securing said discharge reed between said discharge reed retainer and said valve plate wherein said discharge reed retainer and said second inner wall define a debris trap for separating debris from the fluid and preventing the debris from entering said exhaust port.

11. A compressor assembly for compressing a fluid and using oil for lubrication, said assembly comprising:

a compressor housing defining a compression chamber;

a piston disposed in said compression chamber and slidably movable within said compression chamber for compressing the fluid;

a manifold housing coupled to said compressor housing and defining an intake port, an exhaust port and a control valve port and having an outer wall, a first inner wall and a second inner wall internal to said outer wall and said first inner wall;

a suction chamber defined by said outer wall and said first inner wall in fluid communication with said intake port for receiving the fluid from said intake port and for guiding the fluid to said compression chamber;

a discharge chamber defined by said first inner wall and said second inner wall for receiving the fluid from said compression chamber;

an aperture formed in said first inner wall for guiding the fluid and the oil from said discharge chamber to said control valve port wherein said second inner wall includes a continuous outer surface defining a partition between said aperture and said exhaust port such that the oil pools in said discharge chamber between said first inner wall and said second inner wall thereby retaining the oil in said compressor to lubricate said compressor;

an exit chamber defined by said second inner wall in fluid communication with said exhaust port for guiding the fluid from said discharge chamber to said exhaust port; and an exhaust housing integrally formed with said manifold housing further defining said exhaust port and including a first channel wall having an internal surface and a first end defining a first channel in fluid communication with said exit chamber and a second channel wall defining a second channel in fluid communication with said first channel.

12. A compressor assembly for compressing a fluid and using oil for lubrication, said assembly comprising:

a compressor housing defining a compression chamber;

a piston disposed in said compression chamber and slidably movable within said compression chamber for compressing the fluid;

a manifold housing coupled to said compressor housing and defining an intake port, an exhaust port and a control valve port and having an outer wall, a first inner wall and a second inner wall internal to said outer wall and said first inner wall;

a suction chamber defined by said outer wall and said first inner wall in fluid communication with said intake port for receiving the fluid from said intake port and for guiding the fluid to said compression chamber;

a discharge chamber defined by said first inner wall and said second inner wall for receiving the fluid from said compression chamber;

an aperture formed in said first inner wall for guiding the fluid and the oil from said discharge chamber to said control valve port wherein said second inner wall defines a partition between said aperture and said exhaust port such that the oil pools in said discharge chamber between said first inner wall and said second inner wall thereby retaining the oil in said compressor housing to lubricate said compressor assembly;

an exit chamber defined by said second inner wall in fluid communication with said exhaust port for guiding the fluid from said discharge chamber to said exhaust port; and a valve plate positioned between said manifold housing and said compression chamber wherein said valve plate and said second inner wall define a trap for separating debris from the fluid and preventing the debris from enterin said exhaust port.

13. A head assembly for use in a compressor defining a compression chamber for compressing a fluid, said assembly comprising:

a manifold housing defining an intake port, an exhaust port, and a control valve port and having an outer wall, a first inner wall and a second inner wall;

a suction chamber defined between said outer wall and said first inner wall in fluid communication with said intake port for receiving the fluid from said intake port and for guiding the fluid to the compression chamber;

a discharge chamber defined between said first inner wall and said second inner wall for receiving the fluid from the compression chamber;

an exit chamber defined within said second inner wail in fluid communication with said discharge chamber and said exhaust port for guiding the fluid from said discharge chamber to said exhaust port; and an exhaust housing integrally formed with said manifold housing further defining said exhaust port and including a first channel wall defining a first channel in fluid communication with said exit chamber and a second channel wall defining a second channel in fluid communication with said first channel.

14. A head assembly for use in a compressor defining a compression chamber for compressing a fluid, said assembly comprising:

a manifold housing defining an intake port and an exhaust port and having an outer wall, a first inner wall and a second inner wall;

a suction chamber defined between said outer wall and said first inner wall in fluid communication with said intake port for receiving the fluid from said intake port;

a discharge chamber defined between said first inner wall and said second inner wall for receiving the fluid from the compression chamber;

an exit chamber defined within said second inner wall in fluid communication with said exhaust port for guiding the fluid from said discharge chamber to said exhaust port; and a valve plate adjacent said manifold housing wherein said valve plate and said second inner wall define a trap for separating debris from the fluid and preventing the debris from entering said exit chamber.

* * * * *